US008434917B2

(12) United States Patent
Lai

(10) Patent No.: US 8,434,917 B2
(45) Date of Patent: May 7, 2013

(54) INDOOR ILLUMINATING DEVICE

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 297 days.

(21) Appl. No.: 12/905,093

(22) Filed: Oct. 15, 2010

(65) Prior Publication Data

US 2011/0316418 A1 Dec. 29, 2011

(30) Foreign Application Priority Data

Jun. 29, 2010 (TW) ..... 99121131 A

(51) Int. Cl.
*F21V 29/00* (2006.01)

(52) U.S. Cl.
USPC ..... 362/373; 362/249.02; 362/294

(58) Field of Classification Search ..... 362/249.02, 362/800, 373, 294
See application file for complete search history.

(56) References Cited

U.S. PATENT DOCUMENTS

| | | | | |
|---|---|---|---|---|
| 7,766,513 | B2 * | 8/2010 | Zhang et al. | 362/294 |
| 7,841,752 | B2 * | 11/2010 | Lee | 362/373 |
| 7,874,699 | B2 * | 1/2011 | Liang | 362/249.02 |
| 7,922,364 | B2 * | 4/2011 | Tessnow et al. | 362/294 |
| 7,993,025 | B2 * | 8/2011 | Chiu | 362/249.02 |
| 8,157,422 | B2 * | 4/2012 | Paik et al. | 362/294 |
| 8,206,015 | B2 * | 6/2012 | Cho et al. | 362/311.02 |
| 8,246,215 | B2 * | 8/2012 | Lu et al. | 362/294 |
| 8,267,545 | B2 * | 9/2012 | Chen | 362/249.02 |
| 8,272,762 | B2 * | 9/2012 | Maxik et al. | 362/249.02 |
| 8,287,152 | B2 * | 10/2012 | Gill | 362/249.02 |
| 8,317,370 | B2 | 11/2012 | Chien et al. | |
| 8,382,330 | B2 * | 2/2013 | Chang et al. | 362/294 |
| 2011/0164420 | A1 * | 7/2011 | Lee | 362/249.02 |
| 2012/0287637 | A1 * | 11/2012 | Mahalingam et al. | 362/249.02 |

FOREIGN PATENT DOCUMENTS

| | | | |
|---|---|---|---|
| CN | 101469857 | A | 7/2009 |
| TW | M297431 | U | 9/2006 |
| TW | M332168 | U | 5/2008 |
| TW | 201020462 | A | 6/2010 |

* cited by examiner

*Primary Examiner* — Anabel Ton
(74) *Attorney, Agent, or Firm* — Altis Law Group, Inc.

(57) ABSTRACT

An indoor illuminating device includes at least one lamp and a housing. The at least one lamp includes a heat sink and a light emitting portion. The housing includes opposite top wall and bottom wall. The bottom wall defines at least one opening corresponding to the at least one lamp. The heat sink is received in the housing, and the light emitting portion of the at least lamp exposes out of the housing through the at least one opening. The housing further defines a first ventilation opening and a second ventilation opening. The heat sink of the at least one lamp is disposed in an airflow path between the first and second ventilation openings.

18 Claims, 6 Drawing Sheets

INDOOR ILLUMINATING DEVICE

BACKGROUND

1. Technical Field

The present disclosure relates to illuminating devices and, particularly, to an illuminating device with good heat dissipating efficiency.

2. Description of Related Art

At present, in order to extend life and improve light emitting stability, indoor illuminating devices, such as LED lamps, usually use heat sink to improve heat dissipating efficiency thereof. However, the indoor illuminating devices are usually assembled on the ceiling or the top wall of a room, and the air near the ceiling or the top wall of the room usually flows slowly; as a result, the heat generated by the illuminating device cannot be dissipated efficiently through the heat sink, and the life of the illuminating device would be decreased and the light emitting stability would be worse.

What is needed is an indoor illuminating device which can ameliorate the problem of the prior art.

BRIEF DESCRIPTION OF THE DRAWINGS

Many aspects of the present indoor illuminating device can be better understood with reference to the accompanying drawings. The components in the drawings are not necessarily drawn to scale, the emphasis instead being placed upon clearly illustrating the principle of the indoor illuminating device. In the drawings, all the views are schematic.

DETAILED DESCRIPTION

Embodiments of the present disclosure will now be described in detail below, with reference to the accompanying drawings.

Figure 1:
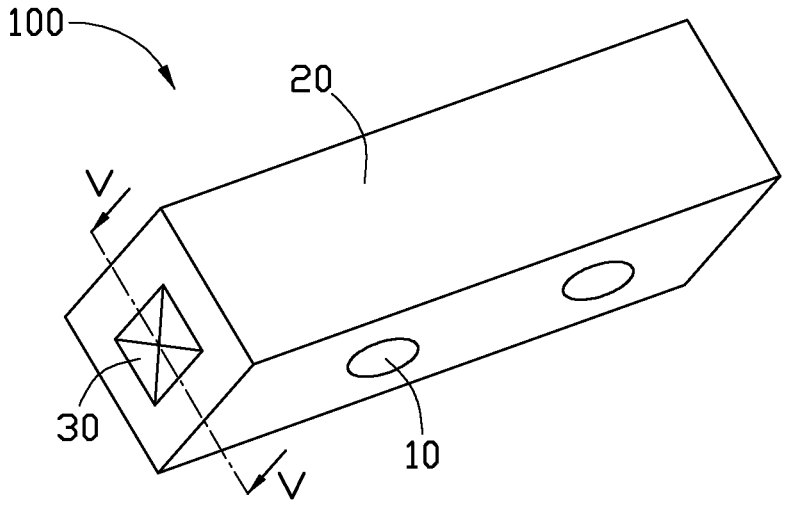
FIG. 1 is an schematic view of an indoor illuminating device according to a first exemplary embodiment.

Referring to FIG. 1, an indoor illuminating device 100 according to a first exemplary embodiment is shown. The indoor illuminating device 100 includes at least one lamp 10, a housing 20, and an airflow generating device 30.

Figure 2:
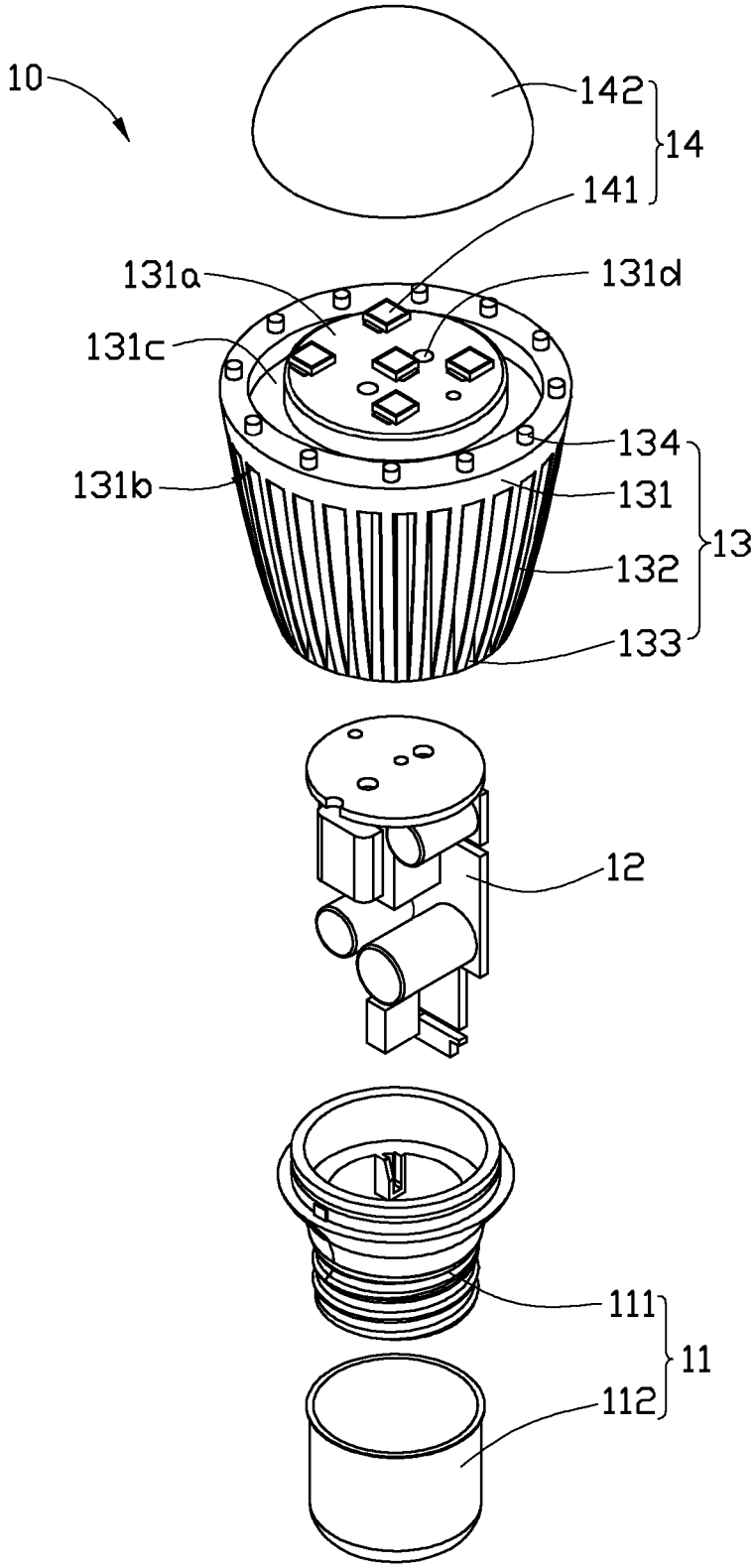
FIG. 2 is an exploded, schematic view of a lamp of the indoor illuminating device of FIG. 1.
Figure 3:
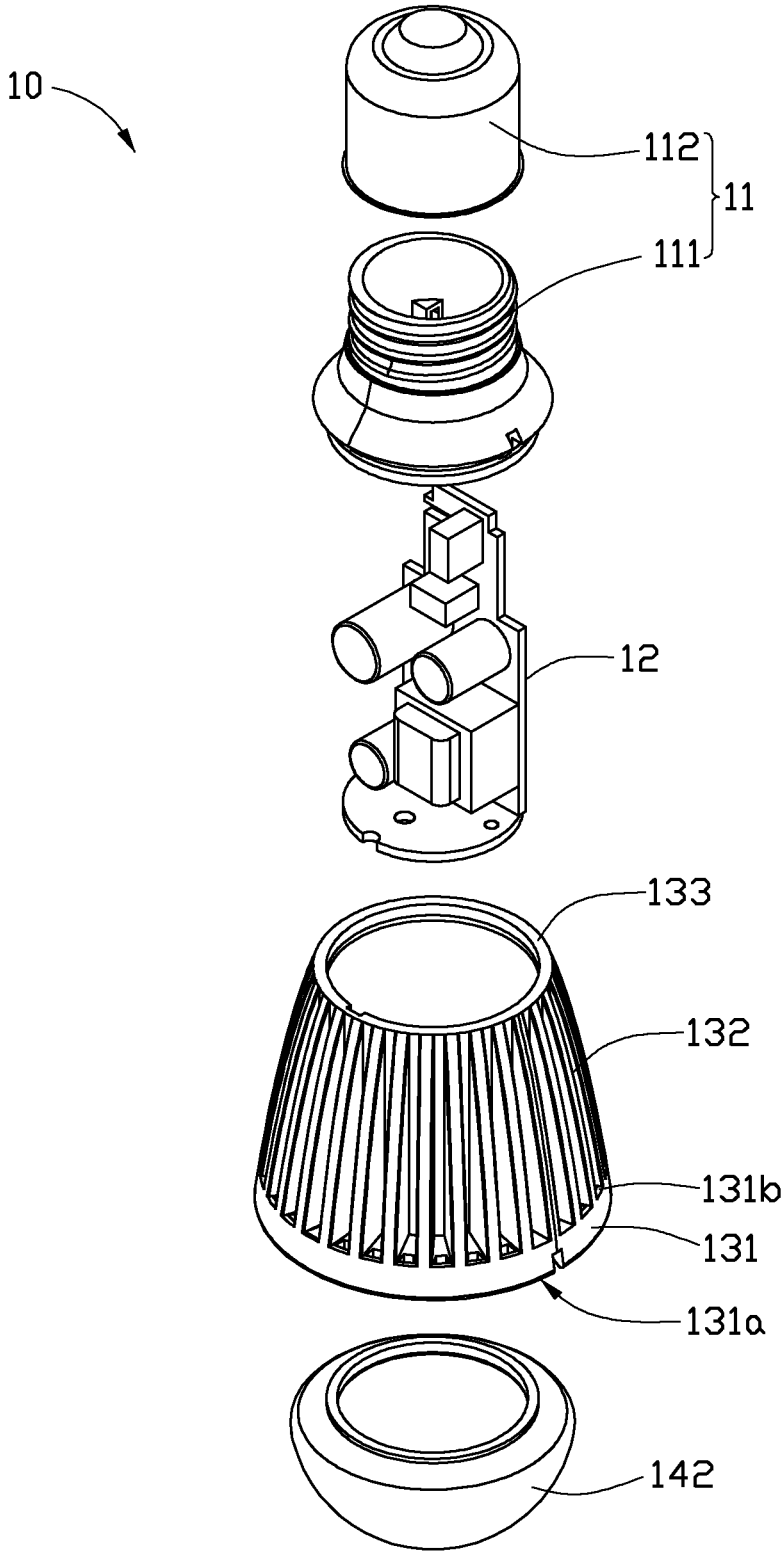
FIG. 3 is an exploded, schematic view of the lamp of FIG. 2, viewed from an opposite side.
Figure 4:
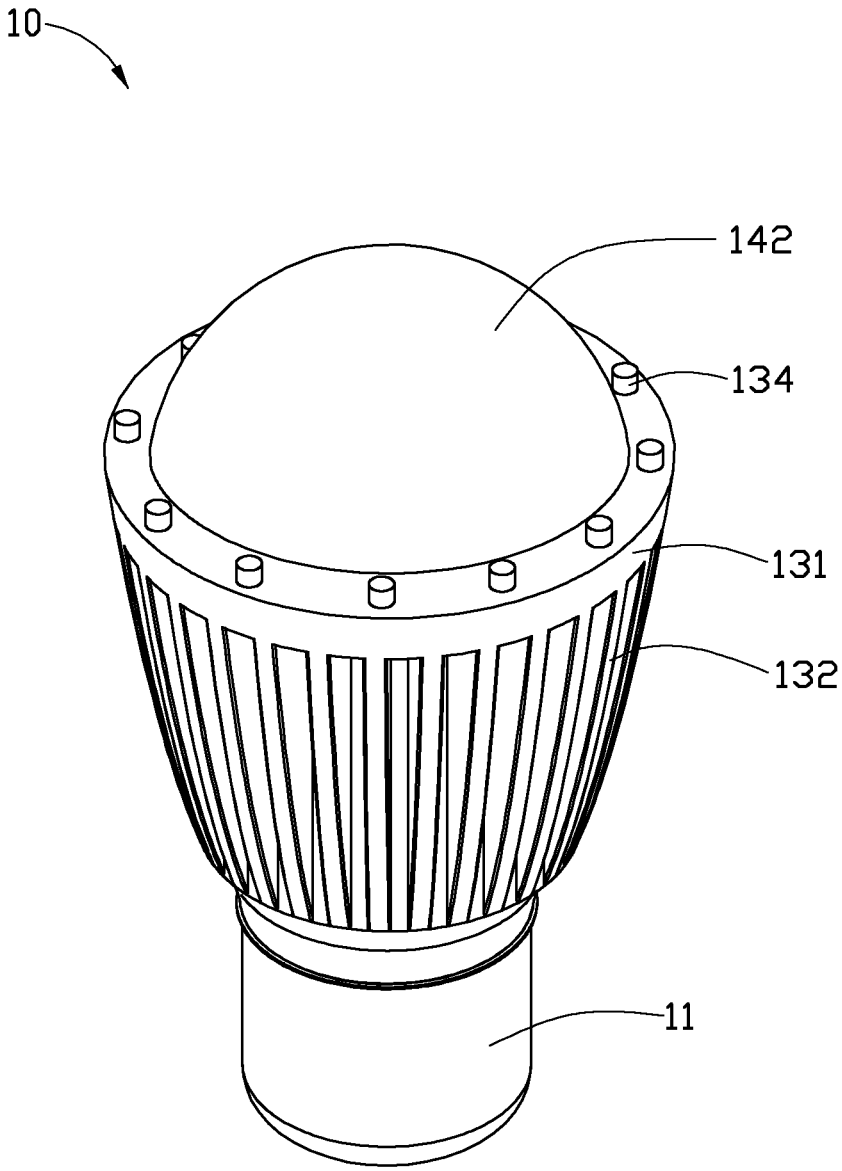
FIG. 4 is an assembled, schematic view of the lamp of FIG. 2.

Referring to FIGS. 2 to 4, in the present embodiment, the lamp 10 includes a lamp holder 11, a driving circuit 12, a heat sink 13, and a light emitting portion 14.

The lamp holder 11 includes a securing portion 111 and an electrical connector 112. The electrical connector 112 is secured to an end of the securing portion 111, and is configured for connecting to a power source (not shown) which can supply power to the lamp 10. The securing portion 111 is configured for securing the driving circuit 12 and the heat sink 13.

The driving circuit 12 is disposed between the lamp holder 11 and the heat sink 13, and is electrically connected to the electrical connector 112 and the light emitting portion 14. The driving circuit 12 is configured for supplying driving voltage to the light emitting portion 14.

The light emitting portion 14 includes at least one light emitting component 141 and a lamp cover 142. In the present embodiment, the light emitting portion 14 includes five light emitting components 141, and the light emitting components 141 are light emitting diodes. It is understood that the number of the light emitting components 141 is not limited to the present embodiment, the number of the light emitting components 141 can also be one, two, three, etc. The lamp cover 142 is configured for protecting the light emitting components 141. The lamp cover 142 can be made of transparent material, such as glass, plastic and so on. In the present embodiment, the lamp cover 142 is hemisphere-shaped.

The heat sink 13 includes a base 131, a number of fins 132, a hollow post 133, and a number of heat dissipating posts 134.

The base 131 includes a first surface 131*a* facing away from the lamp holder 11 and a second surface 131*b* opposite to the first surface 131*a*. The light emitting components 141 are mounted on the first surface 131*a* of the base 131. A circuit board (not shown) can be placed on the first surface 131*a* of the base 131 first, and then, the light emitting components 141 are mounted on the circuit board; or the light emitting components 141 are directly mounted on the first surface 131*a* of the base 131, and are electrically connected to a circuit (not shown) formed on the first surface 131*a* of the base 131, wherein the circuit can be formed on the first surface 131*a* by plating. The base 131 can be made of thermally conductive and electrically insulating material, such as ceramics. The ceramics can be selected from a group consisting of alumina ceramics, aluminum nitride, and so on. If the light emitting components 141 are directly mounted on the first surface 131*a* of the base 131, the heat resistance between the light emitting components 141 and the heat sink 13 can be decreased effectively. The base 131 defines a ring-shaped assembling groove 131*c* surrounding the light emitting components 141 on the first surface 131*a*. The assembling groove 131*c* is used for assembling the lamp cover 142 on the heat sink 13. The base 131 further defines at least one through hole 131*d* running through the first surface 131*a* and the second surface 131*b*. The through hole 131*d* is provided for the electrical connection between the light emitting components 141 and the driving circuit 12, wherein electrical wire (not shown) electrically connecting with the light emitting components 141 extends through the through hole 131*d* to electrically connect with the driving circuit 12.

The heat dissipating posts 134 are formed on the first surface 131*a* of the base 131. The heat dissipating posts 134 are arranged surrounding the ring-shaped assembling groove 131*c*.

The fins 132 and the hollow post 133 are formed on the second surface 131*b* of the base 131. The fins 132 are arranged surrounding the hollow post 133, and each of the fins 132 is connected to an outer surface of the hollow post 133. In the present embodiment, the fins 132, the hollow post 133, and the heat dissipating posts 134 are integrally formed with the base 131. The fins 132, the hollow post 133, the heat dissipating posts 134, and the base 131 can be made of a same material. An end of the hollow post 133 away from the base 131 is fixed to an end of the securing portion 111 away from the electrical connector 112. The driving circuit 12 can be received in the hollow post 133; thus, the volume of the lamp 10 can be decreased.

In the present embodiment, the hollow post 133 is mainly used for fixing the heat sink 13 to the lamp holder 11 and receiving the driving circuit 12 therein conveniently. It is understood, in other embodiments, the connection between the heat sink 13 and the lamp holder 11 is not limited to the present embodiment.

Figure 5:
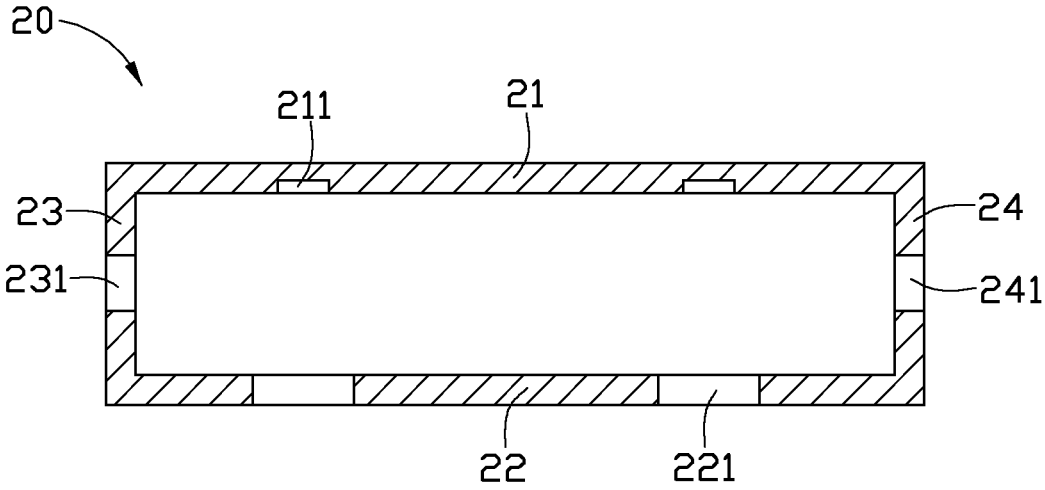
FIG. 5 is a cross sectional view of a housing of the indoor illuminating device taken along line V-V of FIG. 1.

Referring to FIG. 5, the housing 20 includes a top wall 21, a bottom wall 22, a first sidewall 23, and a second sidewall 24. The first sidewall 23 and the second sidewall 24 are connected between the top wall 21 and the bottom wall 22.

The bottom wall 22 defines at least one opening 221. When the lamp 10 is assembled in the housing 20, the light emitting portion 14 can expose out of the housing 20 through the opening 221, while, the heat sink 13 and the lamp holder 11 of the lamp 10 are received in the housing 20. Preferably, the top wall 21 defines an assembling groove 211 corresponding to each opening 221 for securing the lamp holder 11 of the lamp 10 conveniently.

The first sidewall 23 and the second sidewall 24 define a first ventilation opening 231 and a second ventilation opening 241 respectively. The heat sink 13 of each lamp 10 is disposed in the airflow path between the first ventilation opening 231 and the second ventilation opening 241. At least one of the first ventilation opening 231 and the second ventilation opening 241 is connected to the airflow generating device 30. The airflow generating device 30 can be disposed in the first ventilation opening 231 or the second ventilation opening 241, or the airflow generating device 30 can be connected to the first ventilation opening 231 or the second ventilation opening 241 through an air guide pipe (not shown). The airflow generating device 30 is configured for increasing the air flowing speed between the first ventilation opening 231 and the second ventilation opening 241. In the present embodiment, the airflow generating device 30 is disposed in the first ventilation opening 231. In order to improve the heat dissipating efficiency of the lamp 10, preferably, the first sidewall 23 is opposite to the second sidewall 24, and the lamp 10 is disposed between the first sidewall 23 and the second sidewall 24.

It is understood, each of the first ventilation opening 231 and the second ventilation opening 241 can also be located on the top wall 21 or the bottom wall 22.

Figure 6:
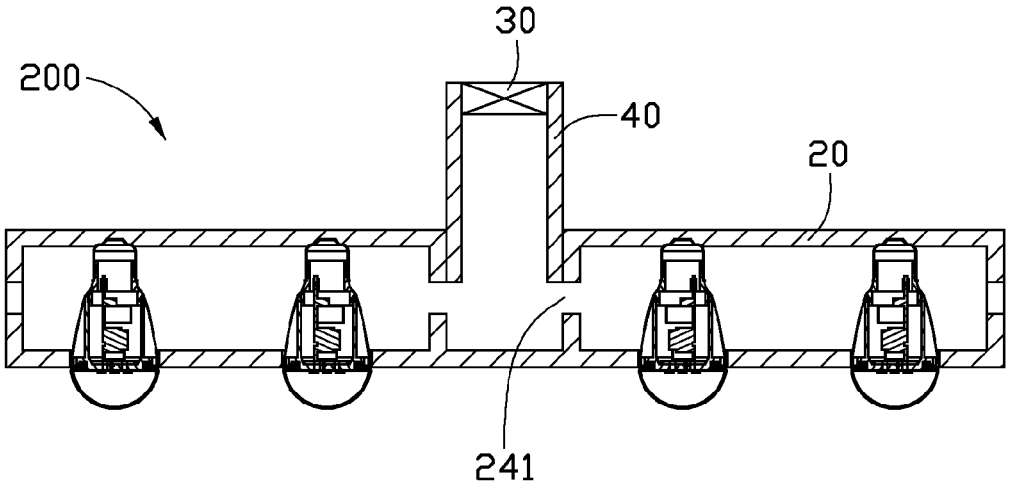
FIG. 6 is a cross sectional view of an indoor illuminating device according to a second exemplary embodiment.

Referring to FIG. 6, an indoor illuminating device 200 according to a second exemplary embodiment is shown. The indoor illuminating device 200 is similar to the indoor illuminating device 100 of first embodiment; the differences between the indoor illuminating device 200 and the indoor illuminating device 100 is that: the indoor illuminating device 200 includes two housings 20, an airflow generating device 30, and an air guide pipe 40; the air guide pipe 40 is vertically located at a center of the indoor illumination device 200, projects upwardly and communicates with the second ventilation openings 241 of the two housings 20. The airflow generating device 30 is disposed in a top of the air guide pipe 40. The airflow generating device 30 is a ventilation fan. Alternatively, although FIG. 6 shows that the air guide pipe 40 is a vertically-extended and rigid pipe, it can be understood by those skilled in the art that the air guide pipe 40 can be a flexible pipe which is connected to a vent of a central air conditioning system or an indoor air exchanging system of a building using the indoor illumination device 200. In such case, the central air conditioning system or the indoor air exchanging system functions as the airflow generating device 30. When the central air conditioning system or the indoor air exchanging system is used, the cost of the indoor illuminating device 200 can be lowered. Preferably, the housing 20 can also be a portion of an airflow pipe of the central air conditioning system or the indoor air exchanging system to further lower the cost of the indoor illuminating device 200. The number of the housings 20 of the indoor illuminating device 200 is not limited to two, in other embodiment, the number of the housings 20 of the indoor illuminating device 200 can also be three, four, five and so on.

While certain embodiments have been described and exemplified above, various other embodiments will be apparent to those skilled in the art from the foregoing disclosure. The disclosure is not limited to the particular embodiments described and exemplified, and the embodiments are capable of considerable variation and modification without departure from the scope and spirit of the appended claims.

What is claimed is:

1. An indoor illuminating device comprising:

at least one lamp comprising a heat sink and a light emitting portion; and a housing comprising a top wall and a bottom wall opposite to the top wall, the bottom wall defining at least one opening corresponding to the at least one lamp, the heat sink of the at least one lamp being received in the housing, and the light emitting portion of the at least one lamp exposing out of the housing through the at least one opening, the housing further defining a first ventilation opening and a second ventilation opening, the heat sink of the at least one lamp being disposed in an airflow path between the first ventilation opening and the second ventilation opening;

wherein the light emitting portion comprises at least one light emitting component, and the heat sink comprises a base and a plurality of fins, the base comprises a first surface facing the light emitting portion and a second surface opposite to the first surface, the at least one light emitting component is mounted on the first surface of the base, and the plurality of fins are formed on the second surface of the base; and wherein the heat sink further comprises a hollow post formed on the second surface of the base, and the plurality of fins are arranged surrounding the hollow post.

2. The indoor illuminating device as claimed in claim 1, wherein the housing further comprises a first sidewall and a second sidewall, the first sidewall and the second sidewall are connected between the top wall and the bottom wall, the first ventilation opening and the second ventilation opening are defined on the first sidewall and the second sidewall respectively, the first sidewall is opposite to the second sidewall.

3. The indoor illuminating device as claimed in claim 1, wherein the at least one lamp further comprises a lamp holder, and the top wall defines an assembling groove corresponding to the at least one opening for securing the lamp holder of the at least one lamp conveniently.

4. The indoor illuminating device as claimed in claim 1, wherein the base is made of thermally conductive and electrically insulating material, the first surface of the base has circuit formed thereon, the at least one light emitting component is directly mounted on the first surface of the base and is electrically connected to the circuit.

5. The indoor illuminating device as claimed in claim 4, wherein the base is made of ceramics.

6. The indoor illuminating device as claimed in claim 1, wherein the fins and the hollow post are integrally formed with the base as a single piece.

7. The indoor illuminating device as claimed in claim 6, wherein the at least one lamp further comprises a driving circuit electrically connecting to the at least one light emitting component, and the driving circuit is received in the hollow post.

8. The indoor illuminating device as claimed in claim 7, wherein the base defines at least one though hole running through the first surface and the second surface of the base, the at least one through hole being adapted for extension of an electrical wire therethrough to electrically connect the at least one light emitting component and the driving circuit.

9. An indoor illuminating device comprising:

at least one lamp comprising a heat sink and a light emitting portion;

a housing comprising a top wall and a bottom wall opposite to the top wall, the bottom wall defining at least one opening corresponding to the at least one lamp, the heat sink of the at least one lamp being received in the housing, and the light emitting portion of the at least one lamp exposing out of the housing through the at least one opening, the housing further defining a first ventilation opening and a second ventilation opening, the heat sink of the at least one lamp being disposed in the airflow path between the first ventilation opening and the second ventilation opening; and an airflow generating device connected to the first ventilation opening or the second ventilation opening.

10. The indoor illuminating device as claimed in claim 9, wherein the airflow generating device is disposed in the first ventilation opening or the second ventilation opening.

11. The indoor illuminating device as claimed in claim 9, wherein the airflow generating device is connected to the first ventilation opening or the second ventilation opening through an air guide pipe.

12. The indoor illuminating device as claimed in claim 9, wherein the airflow generating device is a central air conditioning system or an indoor air exchanging system.

13. The indoor illuminating device as claimed in claim 12, wherein the housing is a portion of an airflow pipe of the central air conditioning system or the indoor air exchanging system.

14. The indoor illuminating device as claimed in claim 9, wherein the housing further comprises a first sidewall and a second sidewall, the first sidewall and the second sidewall are connected between the top wall and the bottom wall, the first ventilation opening and the second ventilation opening are defined on the first sidewall and the second sidewall respectively, the first sidewall is opposite to the second sidewall.

15. The indoor illuminating device as claimed in claim 9, wherein the at least one lamp further comprises a lamp holder, and the top wall defines an assembling groove corresponding to the at least one opening for securing the lamp holder of the at least one lamp conveniently.

16. An indoor illuminating device comprising:

a plurality of lamps, each lamp comprising a heat sink and a light emitting portion;

a plurality of housings, each housing comprising a top wall and a bottom wall opposite to the top wall, the bottom wall defining at least one opening, the heat sink of each lamp being received in a corresponding housing, and the light emitting portion of each lamp exposing out of the corresponding housing through the at least one opening thereof, the housing further defining a first ventilation opening and a second ventilation opening, the heat sink of each lamp being disposed in the airflow path between the first ventilation opening and the second ventilation opening; and an airflow generating device connected to one of the first ventilation opening and the second ventilation opening of each housing.

17. The indoor illuminating device as claimed in claim 16, wherein the airflow generating device is connected to one of the first ventilation opening and the second ventilation opening of each housing through an air guide pipe.

18. The indoor illuminating device as claimed in claim 16, wherein the airflow generating device is a central air conditioning system or an indoor air exchanging system.

* * * * *